United States Patent [19]

Grossman et al.

[11] Patent Number: 4,879,010

[45] Date of Patent: Nov. 7, 1989

[54] RECOVERY OF MERCURY FROM MERCURY COMPOUNDS VIA ELECTROLYTIC METHODS

[75] Inventors: Mark W. Grossman, Belmont; William A. George, Rockport, both of Mass.

[73] Assignee: GTE Products Corporation, Danvers, Mass.

[21] Appl. No.: 259,425

[22] Filed: Oct. 7, 1988

Related U.S. Application Data

[63] Continuation of Ser. No. 815,150, Dec. 31, 1985, abandoned.

[51] Int. Cl.[4] ..... C25C 1/16

[52] U.S. Cl. ..... 204/105 R

[58] Field of Search ..... 204/45.1, 105 R, 157.2, 204/157.21, 157.22, 157.4, 157.41, 157.44, 157.48, 157.5, 157.51

[56] References Cited

U.S. PATENT DOCUMENTS

| | | | |
|---|---|---|---|
| 3,639,222 | 2/1972 | Scheiver et al. | 204/94 |
| 3,673,406 | 6/1972 | Nief et al. | 250/43 |
| 4,214,958 | 7/1980 | Coker et al. | 204/98 |
| 4,292,159 | 9/1981 | Kuo et al. | 204/98 |

OTHER PUBLICATIONS

*Photochemical Isotope Separation of HG-196 by Reaction with Hydrogen Halides,* Webster, C. R. and Zare, R. N., J. Phy. Chem., 85, 1302–1305 (1981).

*Photochemical Enrichment of Hg-196,* Grossman, M., and Maya, J., XIII, Intern. Elec. Con. Tech. Dig., 139–140 (Jun. 18–21, 1984).

*Energy Conservation Through More Efficient Conservation,* Maya, J., Grossman, M. W., Lagushenko, R., Waymouth, J. F., Science, 226, 435–436 (Oct. 26, '84).

Morand et al., *Paper No.* 219, 2058 (1968).

Mueller et al., *Journal of Photochemistry,* 13:109 (1980).

*Primary Examiner*—John F. Niebling

*Assistant Examiner*—David G. Ryser

*Attorney, Agent, or Firm*—Hamilton, Brook, Smith & Reynolds

[57] ABSTRACT

A process for electrolytically recovering mercury from mercury compounds is provided. In one embodiment, Hg is recovered from $Hg_2Cl_2$ employing as the electrolyte solution a mixture of HCl and $H_2O$. In another embodiment, Hg is electrolytically recovered from HgO wherein the electrolyte solution is comprised of glacial acetic acid and $H_2O$. Also provided is an apparatus for producing isotopically enriched mercury compounds in a reactor and then transporting the dissolved compounds into an electrolytic cell where mercury ions are electrolytically reduced and elemental mercury recovered from the mercury compounds.

10 Claims, 3 Drawing Sheets

RECOVERY OF MERCURY FROM MERCURY COMPOUNDS VIA ELECTROLYTIC METHODS

GOVERNMENT RIGHTS

The Government has rights in this invention pursuant to subcontract 4524210 under prime contract DE-AC03-76SF00098 awarded by the U.S. Department of Energy.

This is a continuation of Ser. No. 06/815,150 filed on Dec. 31, 1985 abandoned.

FIELD OF THE INVENTION

This invention is in the field of inorganic chemistry. In particular, it relates to the recovery of pure mercury from mercury compounds utilizing specific conditions in electrolytic baths.

BACKGROUND OF THE INVENTION

Isotopically enriched mercury can be produced by a number of methods. One method involves photosensitized chemical reactions utilizing elemental mercury and various compounds. The compounds HCl and $O_2$ react with mercury atoms when the mercury atoms are excited by resonance radiation, in particular, 2537A radiation produced in a Hg ($^3P_1$-$^1S_0$) transition generating isotopically selective reactions. Thus, the Hg compound formed contains Hg enriched in a particular isotope, and the Hg must be separated from the compound into its free state in order to recover the isotopically enriched metal.

Although it has been possible to separate mercury from mercury compounds by a number of techniques, previously employed techniques suffer from significant disadvantages. For example, it has been possible to separate Hg from $Hg_2Cl_2$ via electroless methods using a mixture of methanol and HCl as an electrolyte solution. However, this method produced low yields and the electrolyte solution had a tendency to become contaminated with impurities and to become blackened and corroded.

Hg can also be separated from HgO via thermal decomposition. However, this requires high temperature baking [T>500° C.] and it can easily result in the introduction of trace impurities into mercury. Additionally, vacuum baking at high temperatures requires hardware and techniques that are very complex.

Also, in the past the yield has been reduced and the danger of exposure to workers has been greatly increased due to the fact that photochemically produced mercury compounds had to be removed manually from the reaction container and then placed in a second container where the mercury was then separated from the mercury compounds.

SUMMARY OF THE INVENTION

This invention provides a unique and novel process for electrolytically reducing mercury (Hg) ions dissociated from mercury compounds in solution. This produces elemental Hg plated onto cathode wires. The yield is enhanced by maintaining the electrolytic solutions at specific conditions.

In one embodiment, mercurous ions are dissociated from $HG_2Cl_2$ in an electrolyte solution and reduced producing elemental Hg. The method for doing this involves employing as the electrolyte solution a mixture of concentrated HCl and $H_2O$. In a preferred method, the electrolytic solution has the relative molar concentration of one mole of HCL/57 moles of $H_2O \pm 20\%$.

In another embodiment, mercuric ions are dissociated from HgO in an electrolyte solution and reduced producing elemental Hg. One method for doing this involves a process wherein the electrolyte solution comprises glacial acetic acid and $H_2O$. In a preferred method, the solution has the relative molar concentration of one mole of glacial acetic acid/66 moles of $H_2O \pm 20\%$.

This invention also provides a unique and novel apparatus for producing isotopically enriched mercury compounds in a reactor and then transporting the dissolved compounds into an electrolytic cell where mercury ions are electrolytically reduced and plated onto a cathode. The resultant electrolytes are then transported back into the initial reactor where they once again dissolve isotopically enriched mercury compounds. The resultant solution is then transported to the electrolytic cell where the mercury ions are reduced and elemental mercury plates onto the cathode.

DETAILED DESCRIPTION OF THE INVENTION

This invention comprises a method for electrolytically recovering mercury from mercury compounds. In particular, it discloses a method for electrolytically recovering Hg from $Hg_2Cl_2$ and HgO.

To recover Hg from $Hg_2Cl_2$ is added to an electrolyte solution containing concentrated HCl and $H_2O$ forming mercurous ions as a result of the dissociation of $Hg_2Cl_2$ in solution. In a preferred method, the solution has the relative molar concentration of 1 mole of HCl/57 moles of $H_2O \pm 20\%$. $Hg_2Cl_2$ is added to this solution. In a particularly preferred embodiment, $Hg_2Cl_2$ is added until the solution is saturated and the electrolyte solution is stirred to promote dissociation of $Hg_2Cl_2$.

An anode and a cathode are then placed into the electrolytic solution. An inert wire such as platinum can be used as the anode and the wire to be plated with Hg is used as the cathode. The cathode wire can be purified copper, nickel or Niron. (Niron is a trademark for a magnetic alloy composed of about 50% nickel and 50% iron manufactured by Amax Corporation of Orangeburg, S.C.).

An electric voltage of 0.9 or higher (as determined by the I-V characteristic of the system) is then applied across the anode and the cathode. Voltages below 1.3 produce good results for unsaturated solutions of $Hg_2Cl_2$ for the types of wire cathode mentioned above. The electric voltage creates an electric current which passes from the anode through the electrolyte solution to the cathode whereby mercurous ions are reduced and elemental mercury is plated onto the cathode. The electrolyte solution is kept at a temperature of about 25° C. and the solution is stirred to promote the dissociation of $Hg_2Cl_2$.

Figure 1:
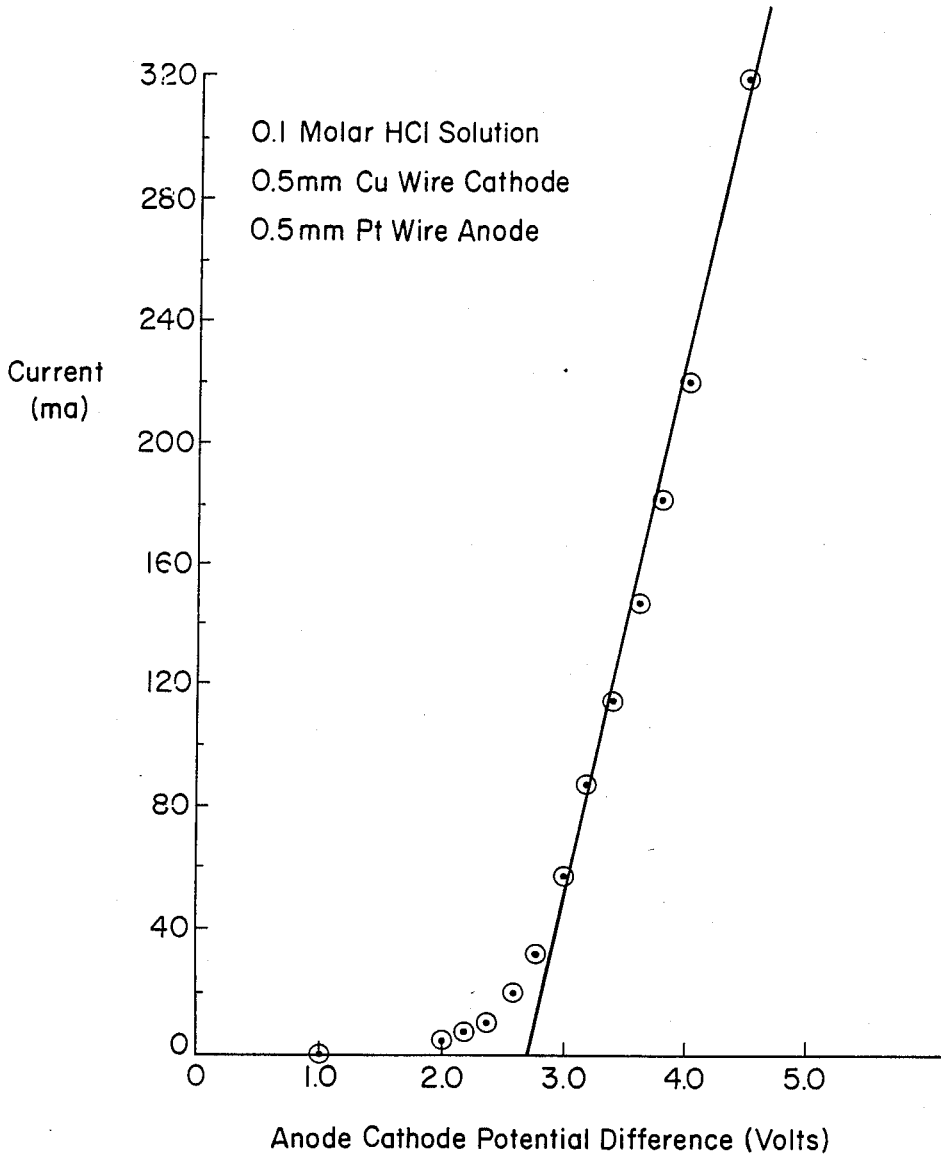
FIG. 1 is a decomposition curve for dilute HCl solutions with excess $Hg_2Cl_2$.

To determine the ideal voltage which should be applied to the anode and the cathode for successful plating, the I-V or decomposition characteristic of the system must be determined. This is determined by plotting the current as a function of voltage as illustrated in FIG. 1 for the reduction of mercurous ions dissociated from $Hg_2Cl_2$ in a solution of HCl and $H_2O$. This graph shows two distinct phases. The initial phase depicts a climb in current as a high enough voltage is reached so as to allow the Hg ions to begin to be reduced. A similar curve results when current is plotted as a function of voltage during the electrolytic reduction of mercuric ions dissociated from HgO in a solution of glacial acetic acid and $H_2O$.

At 0.9 volts, mercurous ions start to be reduced. As the voltage is further increased, the current climbs very slowly indicating substantial Hg ion reduction. However, when the voltage reaches a certain point, called the breakdown voltage, the current rises sharply indicating that other chemical reactions are occurring at significant rates. The excess voltage causes these additional chemical reactions to occur.

Impurities are produced when the breakdown voltage level is reached. This is due to the electrolyte breakdown which occurs as a consequence of the additional chemical reactions which take place when the breakdown voltage is reached. The fact that the breakdown voltage has been reached can be determined by the fact that there is a steep increase in the current. The ammeter serves as a process parameter check rather than a direct measure of Hg plating rate due to the fact that it indicates the increase in current caused by these additional chemical reactions. Electrolyte decomposition is a particular problem during the electrolytic recovery of Hg from $Hg_2Cl_2$, and electrolyte breakdown or separation can become severe when the electrolyte solution is not saturated with $Hg_2Cl_2$. Under saturated solution conditions, high voltage plating gives relatively pure Hg samples. When plating takes place under the unsaturated condition, the plated material is black and porous (possibly $Hg_2O$) and the solution becomes green (possibly mercury perchlorate being formed) unless care is taken to operate below the breakdown voltage.

Most of the decomposition current is due to decomposition of the electrolyte rather than Hg ion reduction. For $Hg_2Cl_2$, even though higher voltages could yield higher deposition rates, it also results in substances other than mercury being plated, so a compromise between plating rate and electrolyte breakdown must be found. The specific voltage value is determined from the I-V characteristic of the system.

However, electrolyte decomposition is not a significant problem during the electrolytic reduction of mercuric ions dissociated from HgO in an electrolyte solution of glacial acetic acid and water. The reduction of mercuric ions obtained from HgO is usually run at 50 ma for milligram and submilligram amounts of HgO. Voltages as high as 17 volts can be used to obtain this amperage without producing electrolyte decomposition. If even less electrolyte decomposition is desired, lower voltages such as six volts can be used.

As mentioned above, from the decomposition curve, it can be determined at what voltage the Hg ions start to be reduced and where the breakdown voltage lies. The voltage between where the Hg ions begin to be reduced and the breakdown voltage lies in the I-V characteristic of the system. It is within this voltage range that optimal plating of Hg is obtained.

For the separation of Hg from HgO, an inert wire such as platinum can be also used as the anode and the wire to be plated with Hg is used as the cathode. A purified nickel or copper wire can be used as the cathode. In electrolytically recovering Hg from HgO, the electrolyte solution used is a mixture of glacial acetic acid and $H_2O$. Upon addition of HgO to the electrolyte solution, mercuric $Hg^{2+}$ ions are formed as a result of the dissociation of HgO in solution. In a preferred embodiment, the solution is in the relative molar concentration of 1 mole of glacial acetic acid to 66 moles of $H_2O \pm 20\%$.

HgO is dissolved into the electrolyte solution and an electric voltage (the maximum specific value being determined by the I-V characteristic of the system) can be applied across the anode and the cathode creating an electric current from the anode to the cathode whereby mercuric ions are reduced and elemental mercury is plated onto the cathode. Due to the fact that relatively high voltage is required to produce electrolyte decomposition during the reduction of mercuric ions from HgO in glacial acetic acid, very little attention is paid to voltage. Instead of voltage, amperage is the parameter which is most carefully monitored to promote the most rapid and complete reduction and plating of mercuric ions. At 50 ma, using a cathode which is 2.5 cm long and 0.05 cm in diameter, made of either copper or nickel and a 2.5 cm long 0.05 cm diameter platinum wire as the anode, one obtains rapid and complete reduction and plating of mercuric ions from HgO in glacial acetic acid and $H_2O$. 50 ma is reached by applying about 17 volts across the anode and the cathode. The electrolyte solution is kept at a temperature of about 25° C. and is stirred.

The cathodes used in the separation of mercury from HgO and H form $Hg_2Cl_2$ alloys having positive interaction enthalpies ($\Delta H > 0$). This implies that the plated Hg will tend to stay as free metal rather than chemically combine with these cathode materials.

Figure 2:
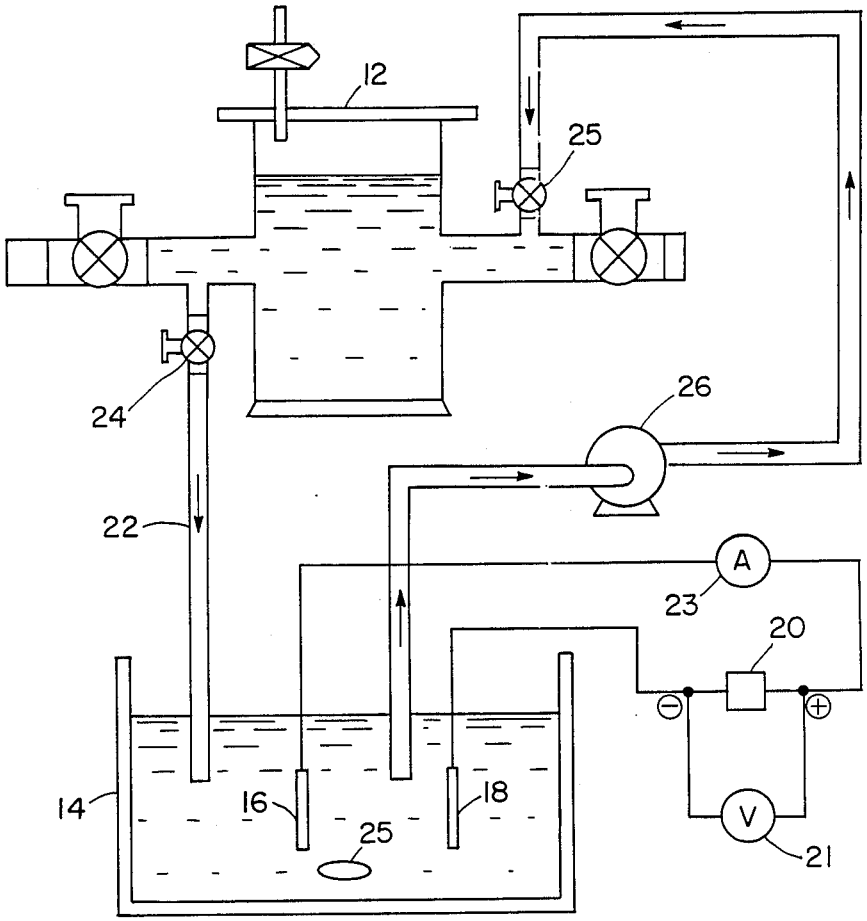
FIG. 2 is a schematic drawing of an apparatus for the remote recovery of mercury from mercury compounds.

An apparatus particularly suitable for the remote recovery of mercury compounds is illustrated in FIG. 2. This apparatus comprises a reactor 12 for producing compounds which contain isotopically specific mercury. For example, see Webster C. and Zare R., "*Photochemical Isotope Separation of Hg*-196 by Reaction with Hydrogen Halides", J. Phys. Chem. 85, 1302–1305 (1981), the teachings of which are hereby incorporated by reference. An electrolytic cell 14 is in fluid communication with reactor 12, said electrolytic cell being used for electrolytically recovering mercury from the mercury compounds produced in reactor 12.

The electrolytic cell 14 also contains therein an anode 16 which can be made of platinum and a cathode 18 which can be made of purified nickel, copper or Niron. A power supply 20 applies an electric voltage to the anode and cathode of the electrolytic cell 14 for carrying out the electrolytic recovery of mercury. Voltmeter 21 measures voltage which is applied across the anode and the cathode. Ammeter 23 measures the electric current, created by the electric voltage, running from the anode through the electrolyte solution to the cathode. Stirring bar 25 is used to stir the electrolyte solution.

Fluid connecting means 22 allow reactor 12 and electrolytic cell 14 to be in fluid communication with each other, thus allowing any electrolyte solution in the reactors to be circulated between the two reactors. The fluid connecting means also contain valves 24 and 25 for regulating the circulation of the electrolyte solution between reactor 12 and electrolytic cell 14. The apparatus also contains a pumping means 26 which causes the electrolyte solution in reactor 12 and the fluid in the electrolytic cell 14 to circulate between said reactor 12 and electrolytic cell 14. The circulation of the electrolyte solution causes the mercury compounds produced in reactor 12 to be transported to electrolytic cell 14, where reduction and recovery of mercury occurs through electrolytic means. By using this apparatus, human contact with the toxic mercury is greatly reduced.

In practice, electrolyte solution and elemental mercury are placed in reactor 12. A photochemical reaction takes place in reactor 12 producing enriched mercury compounds. After the enriched mercury compounds are produced, they are dissociated by the electrolyte solution forming mercury and chlorine (Cl) ions in solution. Valve 24, which regulates the circulation of fluids between reactor 12 and electrolytic cell 14, is opened and the solution containing the dissolved enriched mercury compounds is pumped by pumping means 26 from reactor 12 to electrolytic cell 14. After this is completed, valve 24 is shut and the Hg ions in solution are reduced and enriched elemental mercury is plated onto the cathode.

After the reduction is completed, valve 25 is opened and the electrolyte solution is pumped from the electrolytic cell 14 into reactor 12 where the electrolyte solution again dissolves the enriched mercury compounds which had been previously produced in reactor 12 and the resultant solution is transported to electrolytic cell 14.

In this way, the components of the system need not be disassembled for product collection and human exposure to toxic materials is reduced. This can also improve process reproducibility because it avoids breaking and reforming vacuum seals. Also, it provides a way of automating the Hg isotope enrichment process.

Figure 3:
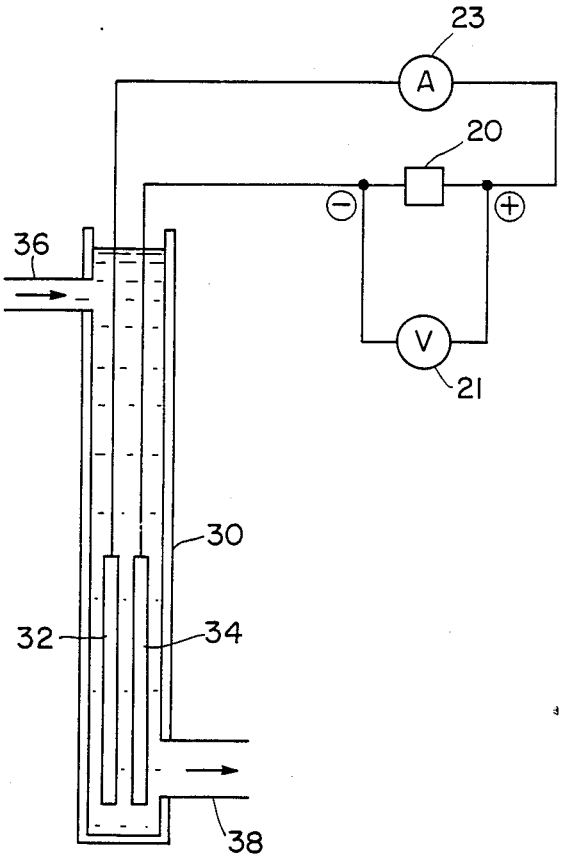
FIG. 3 illustrates a preferred embodiment of the electrolytic cell of the apparatus shown in FIG. 2.

FIG. 3 illustrates a preferred embodiment of electrolytic cell 14. This embodiment is so designed to take advantage of the fact that the plating rate and plating completeness of mercury is greatly improved by maximizing the ratio of surface area of electrode to volume of electrolyte solution. The maximum surface area to volume ratio of electrodes to electrolyte solution is limited by the fact that the electrodes cannot be in contact with each other and the cathode containing the mercury must be removable from the container. As can be seen by the illustration in FIG. 3, the electrolytic cell 30 is long and narrow corresponding to the long and narrow anode 32 and cathode 34. The fluid intake 36 is at the top of the electrolytic cell while the fluid exit 38 is at the bottom of the electrolytic cell. The electrolytic cell, in this case, is cylindrically shaped.

INDUSTRIAL APPLICABILITY

The invention described herein relates to a method for obtaining mercury from mercury compounds via electrolytic means. This invention also relates to an apparatus for the remote recovery of mercury from mercury compounds. Isotopically enriched mercury useful in fluorescent lamps can be produced employing these processes and apparatus.

EQUIVALENTS

Those skilled in the art will recognize or be able to ascertain, using no more than routine experimentation, many equivalents to the specific embodiments described herein. Such equivalents are intended to be covered by the following claims.

We claim:

1. A process for the production of isotopically specific elemental mercury from a compound comprising:

a. producing an isotopically specific mercury compound in a reactor for producing such a mercury compound;

b. dissociating said mercury compound into ions which are soluble in an electrolyte solution, said electrolyte solution contained in said reactor, thereby producing isotopically specific mercury ions within said electrolyte solution;

c. transporting said electrolyte solution containing the isotopically specific mercury ions to an electrolytic cell by means of a fluid connecting means connected to the reactor and the electrolytic cell, said electrolytic cell containing an anode and a cathode;

d. applying an electric voltage across said anode and cathode, thus passing an electric current from the anode through said electrolyte solution to the cathode wherein the isotopically specific mercury ions in the electrolyte solution are reduced and isotopically specific elemental mercury is plated onto the cathode and thereafter recovering said elemental mercury; and e. transporting the electrolyte solution back to the reactor through fluid connecting means, such that additional isotopically specific mercury compound can be dissociated and transported to the electrolytic cell wherein additional elemental isotopically specific mercury can be recovered.

2. A process of claim 1, wherein $Hg_2Cl_2$ containing isotopically specific Hg is produced in the reactor and mercurous ions are formed in the electrolyte solution and reduced in the electrolytic cell to form elemental mercury.

3. A process of claim 2, wherein the electrolyte solution comprises a mixture of concentrated HCl and $H_2O$.

4. A process of claim 3, wherein the electrolyte solution comprises:

a mixture of concentrated HCl and $H_2O$ in the relative concentration of 1 mole of HCl/57 moles of $H_2O \pm 20\%$.

5. A process of claim 4, wherein the voltage applied across the anode and cathode is about 0.9 volts or higher, the specific value being determined by the I-V characteristics of the system.

6. A process of claim 5, wherein the cathode is a metal selected from the group consisting of purified copper, nickel, and Niron.

7. A process as recited in claim 1, wherein HgO containing isotopically specific Hg is produced in the reactor and is dissociated in the electrolyte solution to produce isotopically specific mercuric ions in solution, said ions being reduced in the electrolytic cell to form isotopically specific elemental mercury.

8. A process as recited in claim 7, wherein the electrolyte solution is comprised of glacial acetic acid and $H_2O$.

9. A process as recited in claim 8, wherein the electrolyte solution of glacial acetic acid and $H_2O$ is in the relative molar concentration of about 1 mole of glacial acetic acid/66 moles of $H_2O \pm 20\%$.

10. A process of claim 6, wherein the cathode is a metal selected from the group consisting of purified copper and nickel.

* * * * *

UNITED STATES PATENT AND TRADEMARK OFFICE

CERTIFICATE OF CORRECTION

PATENT NO. : 4,879,010

DATED : November 7, 1989

INVENTOR(S) : Mark W. Grossman and William A. George

It is certified that error appears in the above-identified patent and that said Letters Patent is hereby corrected as shown below:

Column 6, Claim 10, line 65, change "6" to ---9---.

Signed and Sealed this

Fifth Day of May, 1992

*Attest:*

DOUGLAS B. COMER

*Attesting Officer*

*Acting Commissioner of Patents and Trademarks*